US010105969B2

(12) United States Patent
Nitta

(10) Patent No.: US 10,105,969 B2
(45) Date of Patent: Oct. 23, 2018

(54) ELASTIC ROLLER

(71) Applicant: SATO HOLDINGS KABUSHIKI KAISHA, Tokyo (JP)

(72) Inventor: Haruhiko Nitta, Hyogo (JP)

(73) Assignee: SATO HOLDINGS KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/505,705

(22) PCT Filed: Aug. 25, 2015

(86) PCT No.: PCT/JP2015/073773
§ 371 (c)(1),
(2) Date: Feb. 22, 2017

(87) PCT Pub. No.: WO2016/031791
PCT Pub. Date: Mar. 3, 2016

(65) Prior Publication Data

US 2017/0291434 A1 Oct. 12, 2017

(30) Foreign Application Priority Data

Aug. 29, 2014 (JP) ..... 2014-175689

(51) Int. Cl.
*B41J 11/00* (2006.01)
*B41J 11/04* (2006.01)
(Continued)

(52) U.S. Cl.
CPC ..... *B41J 11/04* (2013.01); *B41J 3/4075* (2013.01); *B65C 9/30* (2013.01); *B65H 27/00* (2013.01);
(Continued)

(58) Field of Classification Search
CPC ..... B41J 11/04
(Continued)

(56) References Cited

U.S. PATENT DOCUMENTS 4,887,923 A * 12/1989 Ishiwaka ..... B41J 11/04 400/659
5,123,151 A * 6/1992 Uehara ..... G03G 15/2057 219/216
(Continued)

FOREIGN PATENT DOCUMENTS

JP 61-209177 A 9/1986
JP 5-116390 A 5/1993
(Continued)

*Primary Examiner* — Anthony Nguyen
(74) *Attorney, Agent, or Firm* — Foley & Lardner LLP

(57) ABSTRACT

An elastic roller includes an inner layer side elastic member around a roller shaft, and a coating layer surrounding around the inner layer side elastic member, the coating layer contacting a belt-shaped member. The coating layer is made of silicone resin having JIS-C hardness of 20 degrees or less. A base layer and an intermediate layer of the inner layer side elastic member have JIS-A hardness of 30 to 80 degrees. The rubber hardness of the base layer is higher than the rubber hardness of the intermediate layer. The intermediate layer has tearing strength of 25 N/mm or more, the tearing strength being measured using an unnicked angle-shaped test piece in accordance with JIS K 6252. The intermediate layer has internal grooves having a groove angle of 40 to 160 degrees and having a V-shaped cross section.

20 Claims, 6 Drawing Sheets

(51) Int. Cl.
*B41J 3/407* (2006.01)
*B65C 9/30* (2006.01)
*B65H 27/00* (2006.01)

(52) U.S. Cl.
CPC *B65H 2401/113* (2013.01); *B65H 2404/1316* (2013.01); *B65H 2404/532* (2013.01)

(58) Field of Classification Search
USPC ..... 400/659
See application file for complete search history.

(56) References Cited

U.S. PATENT DOCUMENTS

| | | | | |
|---|---|---|---|---|
| 2008/0112741 | A1* | 5/2008 | Nakajima | G03G 15/206 399/333 |
| 2011/0211034 | A1* | 9/2011 | Katayama | B41J 3/4075 347/220 |
| 2014/0065932 | A1* | 3/2014 | Kazuno | C09J 167/00 451/59 |
| 2015/0203316 | A1 | 7/2015 | Nitta | |
| 2016/0200473 | A1 | 7/2016 | Nitta | |

FOREIGN PATENT DOCUMENTS

| | | | |
|---|---|---|---|
| JP | 2011-031426 | A | 2/2011 |
| JP | 2014-097888 | A | 5/2014 |
| JP | 5558618 | B1 | 7/2014 |

* cited by examiner

ELASTIC ROLLER

TECHNICAL FIELD

The present invention relates to elastic rollers configured to prevent a label having an adhesive face from sticking thereto and to prevent such a label from being caught in the roller.

BACKGROUND ART

Conventionally a linerless label has been developed. The linerless label does not include a sheet to be separated (a so-called liner). The sheet is temporarily attached to the rear face of an adhesive layer of the label. Such a linerless label is expected to save a resource because it does not have a liner that will be discarded after use.

FIG. 5 is a perspective view of a conventional linerless label 1 that is wound into a roll. As in a part of FIG. 5 illustrating an enlarged cross section, this linerless label 1 includes a label base 2, an adhesive layer 3 on the rear-face side, a thermosensitive color developing layer 4 on the front-face side, and a transparent separation agent layer 5 on the top of these layers.

The label base 2 has a position detection mark 6 preprinted on the rear face thereof.

The label base 2 may have fixed information (not illustrated) preprinted on the front face thereof as needed. The fixed information may be a mark indicating the label user, the name, and/or other designs.

This linerless label 1 may be separated into a single label piece 1A by cutting it at cutting lines 7 at predetermined intervals.

FIG. 6 is a schematic side view of a thermal printer 8. The thermal printer 8 is configured to be loaded with this linerless label 1 and to print variable information as needed on the linerless label 1. Variable information may be information on commodity information, such as the price and a barcode, or management information on goods or services. The thermal printer 8 includes a feed part 9 of the linerless label 1, a guide part 10, a detection part 11, a print part 12, and a cutting part 13.

The feed part 9 is configured to hold a roll-shaped linerless label 1 and to release the linerless label 1 of a belt shape toward the guide part 10, the detection part 11, the print part 12 and the cutting part 13.

The guide part 10 includes a guide roller 14. Such a guide part 10 is configured to guide the released linerless label 1 toward the detection part 11 and the print part 12.

The detection part 11 includes a position detection sensor 15. The detection part 11 is configured to detect a position detection mark 6 on the rear face of the linerless label 1 so as to detect the position of the linerless label 1 (label piece 1A) relative to the print part 12.

The print part 12 includes a thermal head 16 and a platen roller 17 (elastic roller). The print part 12 is configured to sandwich the linerless label 1 between the thermal head and the platen roller with a predetermined print pressure. The print part 12 is configured to rotary-drive the platen roller 17 at a constant speed. The print part 12 is configured to supply print data to the thermal head 16 to let the thermosensitive color developing layer 4 develop colors. In this way, the print part 12 can print predetermined variable information on the linerless label 1 (label piece 1A).

The cutting part 13 includes a fixed blade 18 and a movable blade 19. The cutting part 13 is configured to cut the printed linerless label 1 at a part corresponding to the cutting lines 7 at predetermined intervals when the linerless label 1 is fed between these blades, whereby the label pieces 1A are ejected.

SUMMARY OF THE INVENTION

Technical Problem

In such thermal printer 8, the platen roller 17 to feed the linerless label 1 for printing is a roller made of an elastic body such as rubber member. In order to avoid sticking of the adhesive of the adhesive layer 3 to the roller, such a roller may be made of a silicone rubber member having non-stick property or a rubber member impregnated with silicone oil. Silicone oil may be coated on the peripheral surface of the platen roller 17 for this purpose.

For a long-term use, however, it is difficult to completely prevent the sticking of the adhesive. The linerless label 1 passing through the platen roller 17 may stick to the platen roller 17 and may be caught in there (see the virtual line in FIG. 6). This causes a paper jam, which will be an obstacle to the normal feeding and printing of the linerless label 1 and ejection of label pieces 1A.

If the printer stops printing and ejection while leaving the linerless label 1 sandwiched between the thermal head 16 and the platen roller 17, then it will be hard to separate the linerless label 1 from the surface of the platen roller 17. In such a case as well, the linerless label 1 will be easily caught in the platen roller similarly to the above.

In general, this leads to the necessity of repeatedly performed maintenance operations, such as cleaning of the peripheral surface of the platen roller 17 and replacing the platen roller 17 with a new one. Therefore, there is a demand for a platen roller 17 (elastic roller) enabling stable feeding and printing for a long time.

In some configurations of the printer, an elastic roller for labels having excellent non-stick property or separation property (release property) is required for rollers other than the platen roller 17 as well. They include a nip roller unit (not illustrated) including a pair of rollers that is rotary-driven to feed the linerless label 1 and a roller configured to simply guide the linerless label 1 as in the guide roller 14.

There is a demand for an elastic roller configured to stably feed the linerless label 1 and a typical label with a liner when any one of them is loaded. That is, an elastic roller that can be used for feeding both of the linerless label and the label with a liner also is demanded.

In order to avoid sticking of the adhesive layer 3, grooves are formed on the outer surface of the platen roller 17, for example, in a trial basis so as to reduce the contact area with the linerless label 1 (with the adhesive layer 3). However, when a typical label with a liner is fed and printed using such a platen roller with grooves, a necessary frictional force (gripping force) cannot be obtained with the liner of the label because of the insufficient contact area with the rear face of the liner. This often causes a problem about the feeding function, such as slipping of the label, and stable feeding and printing cannot be expected.

Such grooves or the like formed in the platen roller 17 lead to easy abrasion of the platen roller 17 as well.

Similarly to the linerless label 1 as stated above, these problems may occur also when feeding or guiding a belt-shaped member made of paper or film having an adhesive layer or a bonding layer on the rear face or an adhesive product such as adhesive tape. Therefore, an elastic roller having excellent non-stick property or separation property (release property) is required.

When the thermal printer 8 as stated above is of a portable type, for example, the platen roller 17 thereof is relatively small. The print part 12 does not require a very high pressure (print pressure) to sandwich a belt-shaped member such as the linerless label 1 between the thermal head 16 and the platen roller 17. If grooves or the like are formed on the outer surface of the platen roller 17, however, the print pressure at the platen roller 17 drops at the part of these grooves especially when fine letters are to be printed. This may cause faint printing (or missing printing) at the part.

In view of these problems, the present invention aims to provide a platen roller and other elastic rollers having excellent non-stick property or separation property (release property).

The present invention aims to provide an elastic roller configured to prevent an adhesive layer of a linerless label and other belt-shaped members from sticking to the surface of the roller.

The present invention aims to provide an elastic roller capable of stably feeding and guiding typical label with a liner and belt-shaped members as well, other than the linerless label.

The present invention aims to provide an elastic roller configured to exert a separation property and a frictional force (gripping force) with a belt-shaped member such as the linerless label or a typical label with a liner and capable of stably feeding and guiding all of these members, and having excellent abrasion resistance and durability.

Solution to Problem

An elastic roller according to one aspect of the present invention comprises: a roller shaft; and an elastic member surrounding around the roller shaft, the elastic roller configured to feed a belt-shaped member while the belt-shaped member contacts the elastic member. The elastic member includes: an inner layer side elastic member surrounding around the roller shaft; and a coating layer surrounding around the inner layer side elastic member, the coating layer contacting the belt-shaped member when feeding the belt-shaped member. The inner layer side elastic member includes a base layer and an intermediate layer that are located from the roller shaft in this order. The base layer and the intermediate layer have a rubber hardness of 30 to 80 degrees, the rubber hardness being measured by a durometer type A in accordance with the standard of JIS K 6253. The rubber hardness of the base layer is more than the rubber hardness of the intermediate layer. The intermediate layer has tearing strength of 25 N/mm or more, the tearing strength being measured using an unnicked angle-shaped test piece in accordance with JIS K 6252. The coating layer is made of silicone resin having hardness of 20 degrees or less, the hardness being measured using a spring-based Asker C type in accordance with SRIS 0101 standard. The coating layer has a thickness of 10 to 100 μm. The intermediate layer has a plurality of internal grooves along the circumferential direction of the intermediate layer. Each of the internal grooves has a width of 25 to 1,300 μm. Each of the internal grooves has a depth of 25 to 500 μm. Each of the internal grooves has a V-shaped cross section and has a groove angle of 40 to 160 degrees.

Preferably, the silicone resin may be of a thermosetting type.

Preferably, the inner layer side elastic member may be made of a thermoplastic elastic material or a thermosetting elastic material.

Preferably, the coating layer may have a plurality of coating layer grooves along a circumferential direction of the coating layer.

Preferably, the intermediate layer may have a flat inner layer platform-shaped apex part between neighboring internal grooves.

Preferably, the coating layer may have a flat coating layer platform-shaped apex part between neighboring coating layer grooves.

Preferably, the internal grooves may have a pitch of 500 to 1,500 μm.

The elastic roller may have a constant diameter in a plane orthogonal to an axial direction of the roller shaft.

The elastic roller may have a diameter in a plane orthogonal to an axial direction of the roller shaft, the diameter gradually decreasing from a center part of the elastic roller toward both ends of the elastic roller along the axial direction of the roller shaft.

The elastic roller may have a diameter in a plane orthogonal to an axial direction of the roller shaft, the diameter of a first end of the elastic roller in the axial direction of the roller shaft being different from that of a second end of the elastic roller in the axial direction thereof.

Preferably, the base layer may have a rubber hardness of 60 to 80 degrees, the rubber hardness being measured by a durometer type A in accordance with the standard of JIS K 6253. The intermediate layer may have a rubber hardness of 30 to 40 degrees, the rubber hardness being measured by a durometer type A in accordance with the standard of JIS K 6253.

Preferably, the intermediate layer may have a tearing strength of 27 to 45 N/mm, the tearing strength being measured using an unnicked angle-shaped test piece in accordance with JIS K 6252.

Preferably, the elastic roller may be disposed in a thermal printer having a thermal head, the elastic roller being a platen roller to be rotary-driven while sandwiching a label as the belt-shaped member between the platen roller and the thermal head. Print pressure between the elastic roller and the thermal head may be 1.0 to 2.0 Kg/2 inches.

Advantageous Effects

An elastic roller of the present invention includes, as an elastic member, an inner layer side elastic member and a coating layer. The inner layer side elastic member surrounds around a roller shaft and includes a base layer and an intermediate layer. The coating layer surrounds around this inner layer side elastic member and contacts a belt-shaped member. Since this coating layer is made of silicone resin having JIS-C hardness of 20 degrees or less, the coating layer can have non-stick property or separation property of the silicone resin with an adhesive layer. The coating layer also can have a frictional force (gripping force) and sufficient abrasion resistance required for a belt-shaped member because the silicone resin is a gelled resin having low hardness (JIS-C hardness is 20 degrees or less). Therefore, the elastic roller can stably feed and guide a linerless label, a typical label with a liner and other belt-shaped members.

The inner layer side elastic member has a rubber hardness of 30 to 80 degrees, the rubber hardness being measured by a durometer type A in accordance with the standard of JIS K 6253. The rubber hardness of the base layer around the roller shaft is more than the rubber hardness of the intermediate layer. The base layer, the intermediate layer, and the coating layer are softer in this order. The intermediate layer has tearing strength of 25 N/mm or more, the tearing strength being measured using an unnicked angle-shaped test piece in accordance with JIS K 6252. That is, the intermediate layer has high tearing resistance. With this configuration, the elastic roller can have more improved wear resistance. Even when friction occurs during feeding of a belt-shaped member, the grooves (concavity and convexity) on the surface are deformed because of elasticity of the rubber, so that pressure can be distributed. This leads to an advantageous effect of reducing wearing-down and damages on the coating layer.

Especially when this elastic roller is used as a platen roller of a thermal printer, pressure applied to the thermal head can be distributed because the internal grooves of the intermediate layer have a V-shaped cross section and have a groove angle of 40 to 160 degrees. This enables printing at a low load (low print pressure) without generating faint printing (or missing printing), and the life of the elastic roller can be lengthened.

DESCRIPTION OF EMBODIMENTS

An elastic roller of the present embodiment includes an inner layer side elastic member, and a coating layer. The inner layer side elastic member has a two-layered structure (a base layer and an intermediate layer) including a harder layer close to a roller shaft and a softer layer close to the coating layer. The coating layer surrounds around the inner layer side elastic member, and contacts a belt-shaped member. The coating layer is made of silicone resin having JIS-C hardness of 20 degrees or less. The coating layer therefore has both of a non-stick property or separation property with an adhesive layer, and a frictional force (gripping force) and abrasion resistance required for a belt-shaped member. The intermediate layer having grooves has specified tearing strength and angle of the grooves. With this configuration, the elastic roller can stably feed and guide a linerless label, a typical label with a liner and other belt-shaped members, and can resist abrasion and have high durability as well.

EXAMPLES

Figure 1:
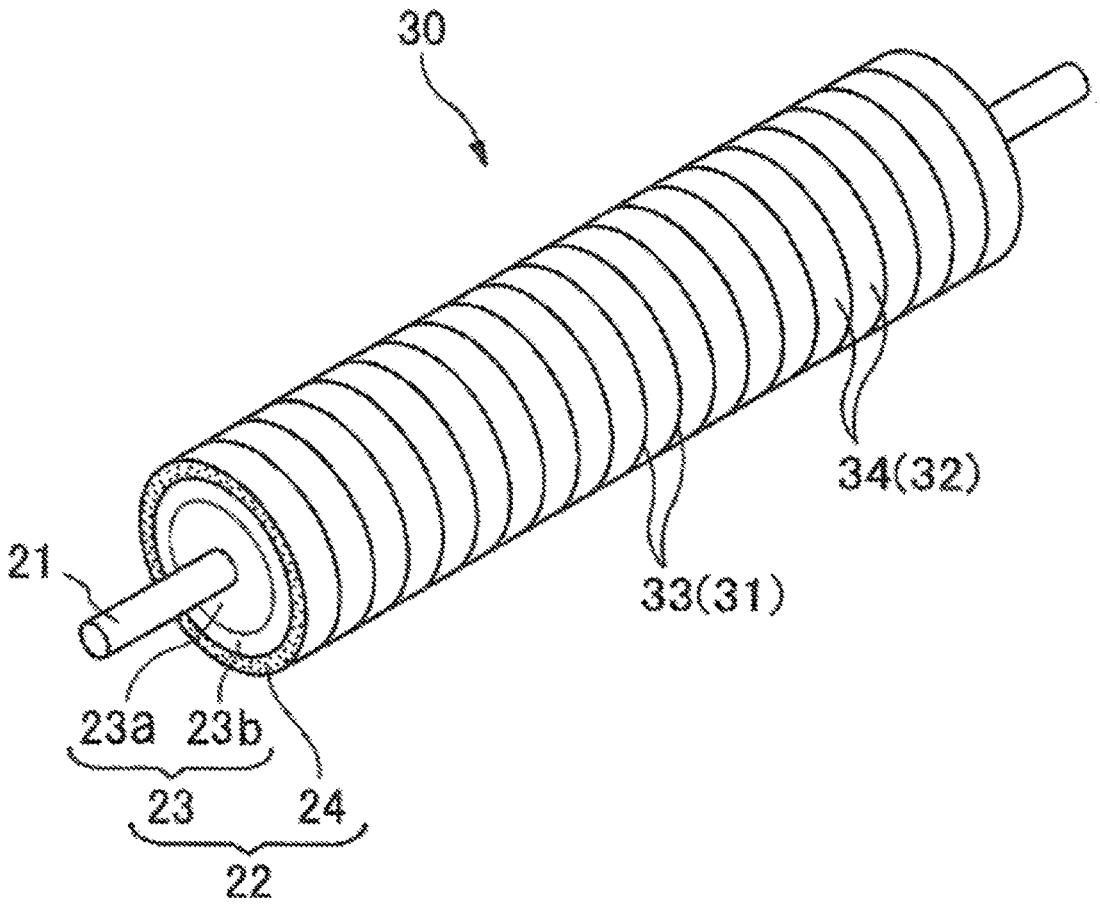
FIG. 1 is a perspective view of an elastic roller (a round-pillar shaped platen roller 30) according to a first example of the present embodiment.
Figure 2:
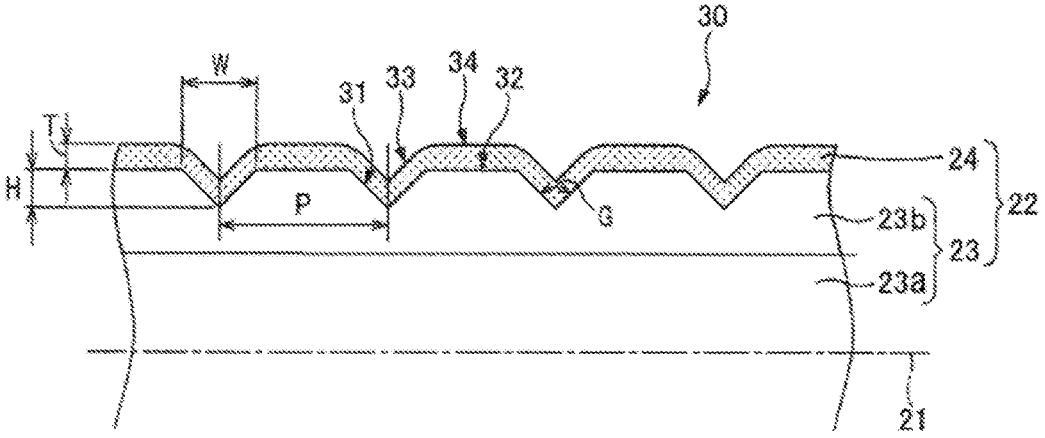
FIG. 2 is an enlarged cross-sectional view of a major part of the platen roller 30 along the axial direction.
Figure 5:
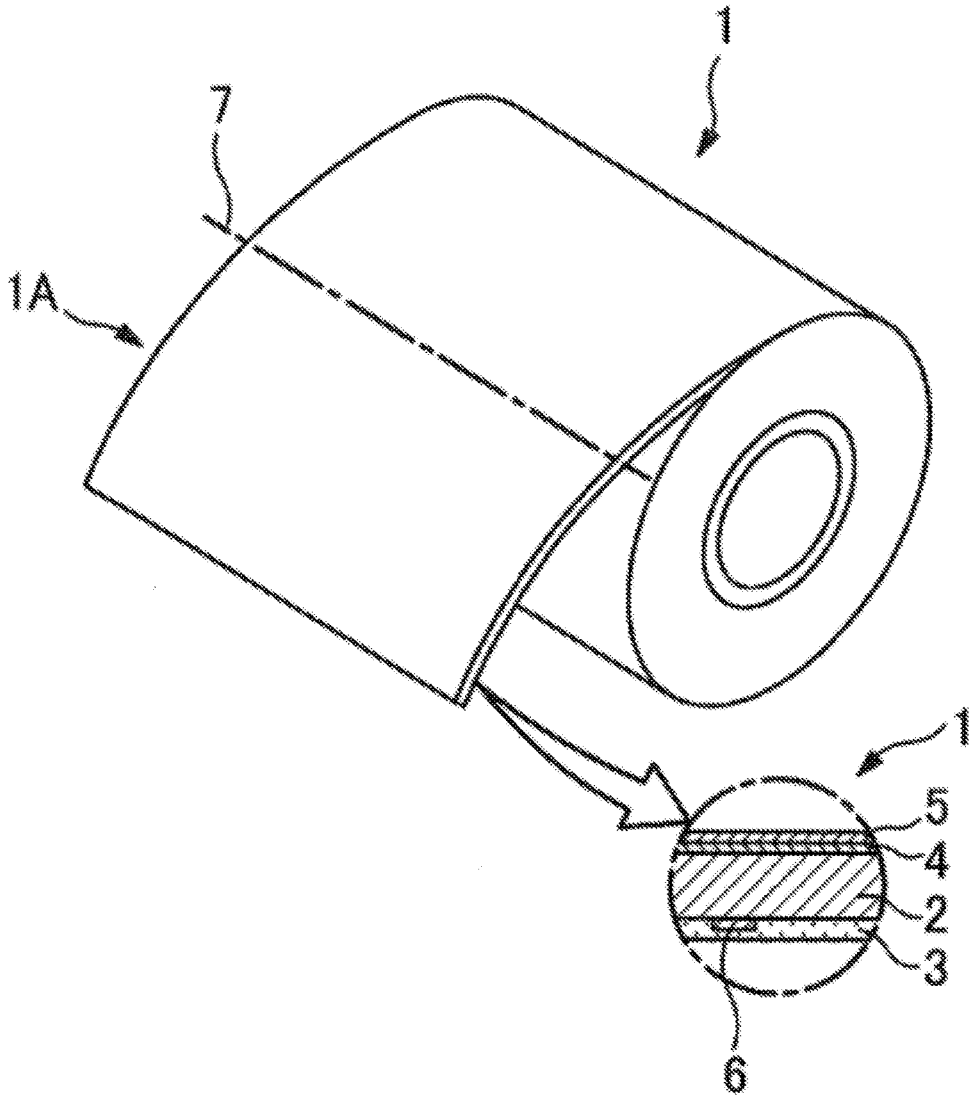
FIG. 5 is a perspective view of a conventional linerless label 1 that is wound into a roll.
Figure 6:
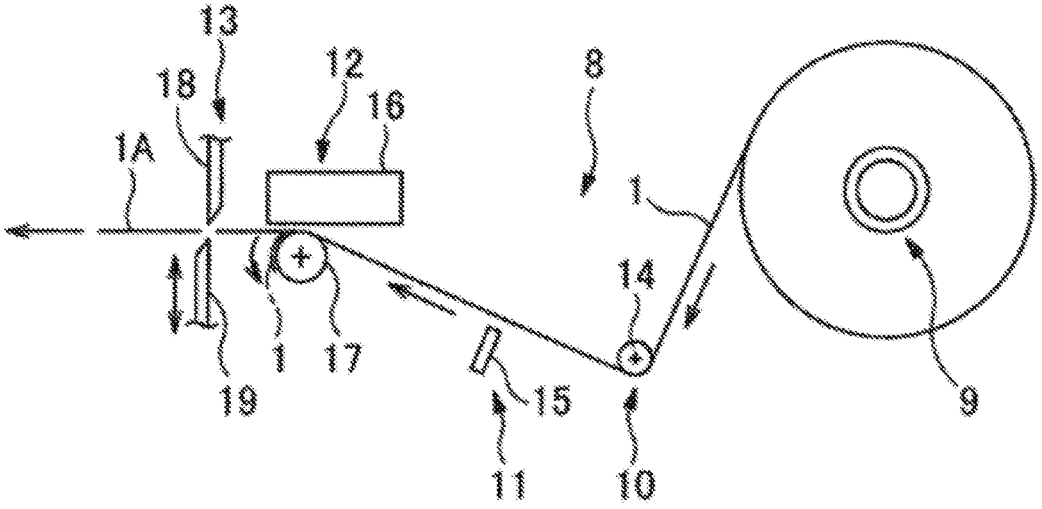
FIG. 6 is a schematic side view of a thermal printer 8 that prints variable information as needed on the linerless label 1 loaded therewith, where variable information may be information on commodity information, such as the price and a barcode, or management information on goods or services.

Referring to FIGS. 1 and 2, the following describes an elastic roller of a first example of the present embodiment in the case where the elastic roller is configured as a platen roller 30 (elastic roller for labels) in the thermal printer 8 similarly to the platen roller 17 (FIG. 6). Like numbers indicate like components in FIGS. 5 and 6, and their detailed descriptions are omitted.

FIG. 1 is a perspective view of the platen roller 30. FIG. 2 is an enlarged cross-sectional view of a major part of the platen roller 30 along the axial direction. The platen roller 30 includes a roller shaft 21 and an elastic member 22. The elastic member 22 surrounds around the roller shaft 21 and is rotatable integrally with the roller shaft. The platen roller 30 is configured to feed a label (e.g., the linerless label 1 in FIG. 5) while the elastic member 22 contacts the label.

The elastic member 22 includes an inner layer side elastic member 23 and a coating layer 24 (external elastic member). The inner layer side elastic member 23 is round-pillar shaped and surrounds around the roller shaft 21. The coating layer 24 is disposed integrally with and around the inner layer side elastic member 23. The coating layer 24 contacts the linerless label 1. The inner layer side elastic member 23 includes a base layer 23*a* and an intermediate layer 23*b* that are located from the roller shaft 21 in this order.

The platen roller 30 has grooves (internal grooves 31 and coating layer grooves 33, described later referring to FIG. 2) formed on the surface thereof.

Materials of these members are described.

The inner layer side elastic member 23 (base layer 23*a* and intermediate layer 23*b*) may be made of a thermoplastic elastic material or a thermosetting elastic material.

Examples of synthetic resins making up the inner layer side elastic member include polyethylene, polypropylene, polymethylpentene, polybutene, crystalline polybutadiene, polybutadiene, styrene-butadiene resin, polyvinyl chloride, polyvinyl acetate, polyvinylidene chloride, ethylene-vinyl acetate copolymer, ethylene-propylene copolymer, ethylene-propylene-diene copolymer, ionomer, polymethylmethacrylate, polytetrafluoroethylene, ethylene-polytetrafluoroethylene copolymer, polyacetal(polyoxymethylene), polyamide, polycarbonate, polyphenylene ether, polyethylene terephthalate, polybutylene terephthalate, polyarylate, polystyrene, polyethersulfone, polyimide, polyamide-imide, polyphenylene sulfide, polyoxybenzoyl, polyether ether ketone, polyetherimide, polystyrene, polyurethane, polyester, 1,2-polybutadiene, phenol resin, urea resin, melamine resin, benzoguanamine resin, diallyl phthalate resin, alkyd resin, epoxy resin, and silicon resin.

Other examples that can be used include thermosetting elastic materials, such as thermosetting silicone rubber, one-component RTV (Room Temperature Vulcanizing) rubber, two-component RTV rubber, LTV (Low Temperature Vulcanizable) silicone rubber, and oil-resistant thermosetting rubber. In particular, millable type silicone rubber is preferable.

Both of the base layer 23*a* and the intermediate layer 23*b* making up the inner layer side elastic member 23 have hardness of 30 to 80 degrees. The hardness is measured by a durometer type A in accordance with the standard of JIS K 6253, and hereinafter this is called "JIS-A hardness".

If the JIS-A hardness is less than 30 degrees, such a platen roller 30 is too soft to feed and guide a belt-shaped member such as the linerless label 1. That is, the platen roller 30 has a problem about the feeding function because of excessive frictional force when contact is made. Print quality of the thermal printer 8 (FIG. 6) also deteriorates.

If the JIS-A hardness exceeds 80 degrees, such a platen roller 30 is too hard. The feeding force and the feeding accuracy of the platen roller 30 deteriorate because of a small gripping force.

The rubber hardness measured by a durometer type A in accordance with the standard of JIS K 6253 is the standard corresponding to ISO-7619-1 and ASTM D 2240.

All of the contents of JIS K 6253 standard, ISO-7619-1 standard and ASTM D 2240 standard are incorporated herein by reference.

The rubber hardness of the base layer 23*a* measured by a durometer type A in accordance with the standard of JIS K 6253 is 60 to 80 degrees, and such rubber hardness of the intermediate layer 23*b* is 30 to 40 degrees. The base layer 23*a* is more in hardness and is harder than the intermediate layer 23*b*.

If the rubber hardness of the base layer 23*a* is less than 60 degrees, the strength of the platen roller as a whole may be insufficient. If the rubber hardness exceeds 80 degrees, the layer is too hard to absorb and reduce the external pressure, and the coating layer 24 may wear down.

If the rubber hardness of the intermediate layer 23*b* is less than 30 degrees, the roller may fail to press the linerless label 1 and other belt-shaped members, and print accuracy or print quality may deteriorate. If the rubber hardness exceeds 40 degrees, the hardness of the intermediate layer 23*b* differs from that of the coating layer 24. In that case, the intermediate layer 23*b* may not contribute to reduce wearing-down of the coating layer 24.

Preferably the base layer 23*a* has a thickness deviation of 0.5 to 8.0 mm and the intermediate layer 23*b* has a thickness deviation of 0.3 to 5.0 mm, which depend on the overall diameter of the platen roller 30. This thickness is to exert a feature resulting from what the intermediate layer 23*b* is softer than the base layer 23*a*. More preferably the thickness deviation is 0.5 to 2.0 mm.

The intermediate layer 23*b* of the inner layer side elastic member 23 has tearing strength of 25 N/mm or more by the tearing test in accordance with JIS K 6252. This tearing test is performed using an unnicked angle-shaped test piece.

If the tearing strength is less than 25 N/mm, sufficient durability cannot be obtained. Although larger tearing strength is desirable, if merely tearing strength is increased, other physical properties, such as hardness and stretch, may be degraded. The upper limit of the tearing strength is limited to about 50 N/mm. Considering a good balance of the properties, the tearing strength of 27 to 45 N/mm is desirable.

The tearing test in accordance with JIS K 6252 (tearing test using an unnicked angle-shaped test piece) is the standard corresponding to ISO 34-1 and ISO 34-2.

All of the contents of JIS K 6252 standard, ISO 34-1 standard and ISO 34-2 standard are incorporated herein by reference.

The coating layer 24 is made of thermosetting silicone resin or other silicone resins having JIS-C hardness of 20 degrees or less. JIS-C hardness is measured using a spring-based Asker C type in accordance with SRIS 0101 standard.

Examples of the silicone resin include silicone resin called silicone gel, RTV (Room Temperature Vulcanizing) liquid silicone rubber, LTV (Low Temperature Vulcanizable) liquid silicone rubber, ultraviolet cure liquid silicone rubber, and thermosetting liquid silicone rubber.

Silicone resins inherently have non-stick property or separation property. Therefore, when the linerless label 1 or the like is pressed to and fed using a roller made of silicone resin, the adhesive layer 3 of the linerless label 1 does not stick to the roller.

Thermosetting silicone resins are relatively easy to adjust the thermosetting conditions, process and set JIS-C hardness.

If JIS-C hardness is 20 degrees or less, such a silicone resin is a gel that is appropriately soft. It has a frictional force (gripping force) required not only with the linerless label 1 but also with a label with a liner and other belt-shaped members, and resists abrasion well.

Therefore, the platen roller 30 made of the resin has a separation property and a gripping force required with all of the linerless label 1, a label with a liner and other belt-shaped members, and can exert stable feeding and guiding functions.

If JIS-C hardness exceeds 20 degrees, elasticity of the coating layer 24 is close to the elasticity of a rubber member. Then adhesiveness of the coating layer 24 on the surface increases rapidly, and the layer wears down easily.

The hardness (JIS-C hardness) measured using a spring-based Asker C type in accordance with SRIS 0101 standard is globally used as a de fact standard to measure low degree of hardness, and is equivalent to JIS K 7312.

All of the contents of SRIS 0101 standard and JIS K 7312 standard are incorporated herein by reference.

The coating layer 24 has a thickness T (FIG. 2) of 10 to 100 μm.

If thickness T is less than 10 μm, the coating layer 24 has non-uniformity in thickness. Therefore, it is difficult to have stable separation property and gripping force.

If thickness T exceeds 100 μm, the layer is brittle as the coating film of the inner layer side elastic member 23 in the platen roller 30, and is easily torn.

Referring next to FIGS. 1 and 2, the following describes grooves, such as internal grooves 31 and the coating layer grooves 33, on the surface of the platen roller 30.

The platen roller 30 has a plurality of internal grooves 31 having a V-shaped cross section along the circumferential direction of the inner layer side elastic member 23 (intermediate layer 23*b*). More precisely, the cross section is taken along in the plane including the center line of the platen roller 30. The coating layer 24 is formed around the inner layer side elastic member 23 with the internal grooves 31.

The inner layer side elastic member 23 (intermediate layer 23*b*) has a flat inner layer platform-shaped apex part 32 between the neighboring internal grooves 31.

The coating layer 24 formed around the inner layer side elastic member 23 has a plurality of coating layer grooves 33 at the positions of the internal grooves 31. The coating layer grooves 33 are along the circumferential direction of the coating layer 24. Each coating layer groove 33 has a substantially V-shaped cross section (see FIG. 2).

The coating layer 24 has a flat coating layer platform-shaped apex part 34 between the neighboring coating layer grooves 33.

The internal grooves 31 and the coating layer grooves 33 may have shapes in cross section other than a V-shape, such as a U-shape, a truncated conical shape, a rectangular shape and other polygonal shapes.

The internal grooves 31 have a pitch P of 500 to 1,500 μm.

If the pitch P of the internal grooves 31 is less than 500 μm, there is little space for processing the inner layer platform-shaped apex part 32 between mutually neighboring internal grooves 31.

If the pitch P of the internal grooves 31 exceeds 1,500 μm, it tends to decrease the ratio of the internal grooves 31 or the coating layer grooves 33 to a whole of the platen roller 30, and to increase the contact area with the linerless label 1 and other belt-shaped members. This will lead to a reduction in separation property of the platen roller 30.

The internal grooves 31 has a width W of 25 to 1,300 μm, preferably 50 to 500 μm.

If the width W of the internal grooves 31 is less than 25 μm, the contact area with the linerless label 1 and other belt-shaped members increases. It tends to reduce separation property of the platen roller 30.

If the width W of the internal grooves 31 exceeds 1,300 μm, pressure at a part of the platen roller 30 to appropriately press and support the linerless label 1 on the side of the adhesive layer 3 decreases. Then missing part to be printed on the label piece 1A tends to occur at the print part 12 of the thermal printer 8, that is, print accuracy may deteriorate.

The internal grooves 31 have a depth H of 25 to 500 μm, preferably 50 to 400 μm.

If the depth H of the internal grooves 31 is less than 25 μm, the contact area with the linerless label 1 and other belt-shaped members increases. It tends to reduce separation property of the platen roller 30.

If the depth H of the internal grooves 31 exceeds 500 μm, pressure at a part of the platen roller 30 to press and support the linerless label 1 on the side of the adhesive layer 3 decreases. Then missing part to be printed on the label piece 1A tends to occur at the print part 12 of the thermal printer 8, that is, print accuracy may deteriorate.

The internal grooves 31 have a groove angle G of 40 to 160 degrees, preferably 90 to 150 degrees.

If the groove angle G of the internal grooves 31 is less than 40 degrees, the contact area with the linerless label 1 and other belt-shaped members increases. It tends to reduce separation property of the platen roller 30.

If the groove angle G of the internal grooves 31 exceeds 160 degrees, pressure at a part of the platen roller 30 to press and support the linerless label 1 on the side of the adhesive layer 3 decreases. Then missing part to be printed on the label piece 1A tends to occur at the print part 12 of the thermal printer 8, that is, print accuracy may deteriorate.

The following describes a rolling angle test (method for measuring a rolling angle) to evaluate non-stick property (separation property) of the elastic roller of the present embodiment.

The linerless label 1 described above in FIG. 5 is fixed on a flat and even base plate so that the adhesive layer 3 is directed upward. For adhesive as the reference in the test, an emulsion adhesive having strong adhesiveness is used. The adhesive has a thickness of 20 μm.

The platen roller 30 to be tested is placed on the adhesive layer 3. Then a weight of 2 Kg in weight is placed thereon to apply the weight to the platen roller for 15 seconds to make the platen roller 30 adhere to the linerless label 1.

After 15 seconds, the weight is removed, and the base plate is inclined by gradually raising one end of the base plate that is parallel to the axial line of the platen roller 30 while fixing the other end of the base plate.

When the platen roller 30 starts to roll downward, the raising of the base plate is stopped. Then, the inclination angle of the base plate at this time is measured. This inclination angle is the rolling angle.

A platen roller 30 having a smaller inclination angle (rolling angle) and rolling easily has high non-stick property. Such a platen roller 30 is suitable to feed the linerless label 1.

An experiment by the present inventor showed that there are no problems in the actual operation as rollers such as the platen roller 17 in the thermal printer 8 (FIG. 6) or a nip roller if an elastic roller has this rolling angle of 30 degrees or less, preferably 15 degrees or less after feeding the linerless label 1 for the distance of 20 Km (Kilometers).

An experiment to feed the linerless label 1 and a label with a liner was performed using the thus configured platen roller 30.

A platen roller 30 was prepared, including the base layer 23*a* made of silicone rubber having JIS-A hardness of 70 degrees and the intermediate layer 23*b* made of silicone rubber having JIS-A hardness of 30 degrees and tearing strength of 36 N/mm. The coating layer 24 around the intermediate layer 23*b* had a thickness T of 50 μm, and was made of thermosetting silicone rubber (silicone gel) having JIS-C hardness of 15 degrees. The internal grooves 31 had the pitch P of 750 μm, the width W of 410 μm, the depth H of 75 μm and the groove angle G of 145 degrees.

For comparison, a platen roller (comparative roller) including an elastic member only made of silicone rubber having JIS-A hardness of 45 degrees and the tearing strength less than 25 N/mm was prepared. This platen roller had the internal grooves 31 only having similar dimensions as those stated above, but did not have the coating layer 24. The experiment to feed the linerless label 1 and a label with a liner using this platen roller was performed.

After feeding the linerless label 1 for 20 Km using the platen roller 30 of this embodiment, the rolling angle of the platen roller 30 was measured by the method as stated above. The measurement was less than 13 degrees. Similarly, the rolling angle measured after normally feeding the label with a liner for 20 Km was less than 9 degrees. From both of the measurements, the platen roller as the elastic roller was sufficient in separation property to feed the linerless label and in gripping force to feed the label with a liner.

After feeding the linerless label 1 for 20 Km, the abrasion rate of the platen roller 30 was 0.05% or less. After feeding a label with a liner for 50 Km, the abrasion rate of the platen roller 30 was 0.5% or less. It was found that the platen roller 30 had sufficient abrasion resistance.

From these test results, the following synergistic effect was confirmed. That is, durability such as abrasion resistance was obtained by decreasing the hardness in sequence from the roller shaft 21 to the periphery and using silicone rubber having the tearing strength of 36 N/mm as the intermediate layer 23*b*. Moreover, separation property was obtained by using thermosetting silicone resin (silicone gel) having JIS-C hardness of 15 degrees as the coating layer 24 formed therearound.

The linerless label 1 was fed using the platen roller as the comparative roller. The comparative roller was made of silicone rubber only having JIS-A hardness of 45 degrees and the tearing strength less than 25 N/mm and did not have the coating layer 24. Feeding was performed normally immediately after the starting of the feeding test due to separation property of the silicone rubber itself. However, after feeding for 0.5 Km, the linerless label 1 was wound around the comparative roller. When the rolling angle of the platen roller as the comparative roller at this time was measured, the platen roller still adhered to the adhesive layer even where the base plate of the tester was inclined by 70 degrees. It was found that this platen roller was unusable for long-distance feeding. When a label with a liner was fed, slip occurred and feeding for a specified distance failed. In this way, it was found that this platen roller did not have a sufficient gripping force.

The elastic roller (platen roller) of the embodiment had the internal grooves 31 in the intermediate layer 23*b* of the inner layer side elastic member 23 as well as the coating layer grooves 33 in the coating layer 24, and had specified tearing strength of the intermediate layer 23*b* and size of the internal grooves 31. Such an elastic roller showed both of a separation property and a gripping force required to feed a linerless label 1 and a label with a liner and abrasion resistance.

A platen roller 30 of the present embodiment was prepared for print test. The length of the platen roller 30 was 2 inches, the diameter of the roller shaft 21 was 5 mm, the thickness deviation of the base layer 23*a* was 1.5 mm, the thickness deviation of the intermediate layer 23*b* was 1.0 mm, and the thickness T of the coating layer 24 was 50 μm. Print pressure between the thermal head 16 and the platen roller 30 was set at 1.0 to 2.0 Kg/2 inches at the print part 12 of the thermal printer 8. The linerless label 1 was sandwiched between the thermal head and the platen roller for feeding and printing. As a result, no faint or missing print occurred, and the platen roller had no problems in print accuracy.

Figure 3:
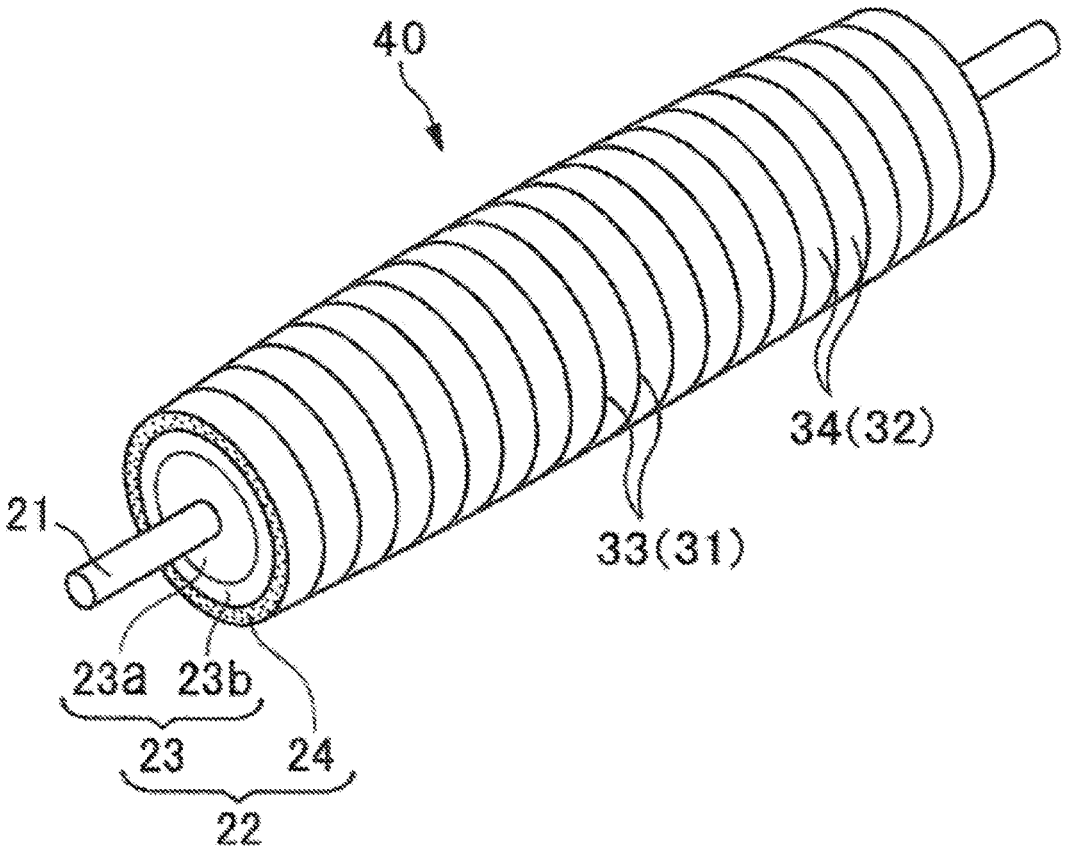
FIG. 3 is a perspective view of an elastic roller (a platen roller 40 having a protruding center) according to a second example of the present embodiment.

FIG. 3 is a perspective view of an elastic roller of a second example of the present embodiment. A platen roller 40 of this example has a protrusion at the center.

The platen roller 40 has a diameter in the plane orthogonal to the axial direction of the roller shaft 21 that gradually decreases from a center part to both ends along the axial direction of the roller shaft 21. That is, this platen roller 40 has a shape such that a center part of the platen roller 30 of a first example (FIG. 1) protrudes.

Other than a so-called barrel-shape, this platen roller 40 includes the inner layer side elastic member 23 (base layer 23*a* and the intermediate layer 23*b*) and the coating layer 24 making up the elastic member 22 that are made of the same materials as those of the first example. The internal grooves 31, the coating layer grooves 33, the inner layer platform-shaped apex part 32 and the coating layer platform-shaped apex part 34 are also the same as those of a first example.

The difference between a diameter of the center part of the platen roller 40 in the axial direction and that of both ends of the platen roller 40 in the axial direction is 10 to 250 μm.

This platen roller 40 is effective for feeding a label having a width narrower than the width of the print part 12 of the thermal printer 8 (the widths of the thermal head 16 and the platen roller 17) and printing thereon. For instance, the effective printing width of a 4-inches printer is 104 mm. If a label (either a linerless label 1 or a label with a liner) of 40 mm in width is set at the center of the print part 12 of this printer for feeding and printing, the platen roller 17 and the thermal head 16 rub against directly at a part not sandwiching the label therebetween. This causes an increase in load or abrasion at this part. When the platen roller 40 having a protruding center part is used for this purpose, a contact between both ends of the platen roller 40 and the thermal head 16 is reduced or they are not in contact. Therefore, feeding and printing are more stable, and the life of the platen roller 40 can be lengthened.

Figure 4:
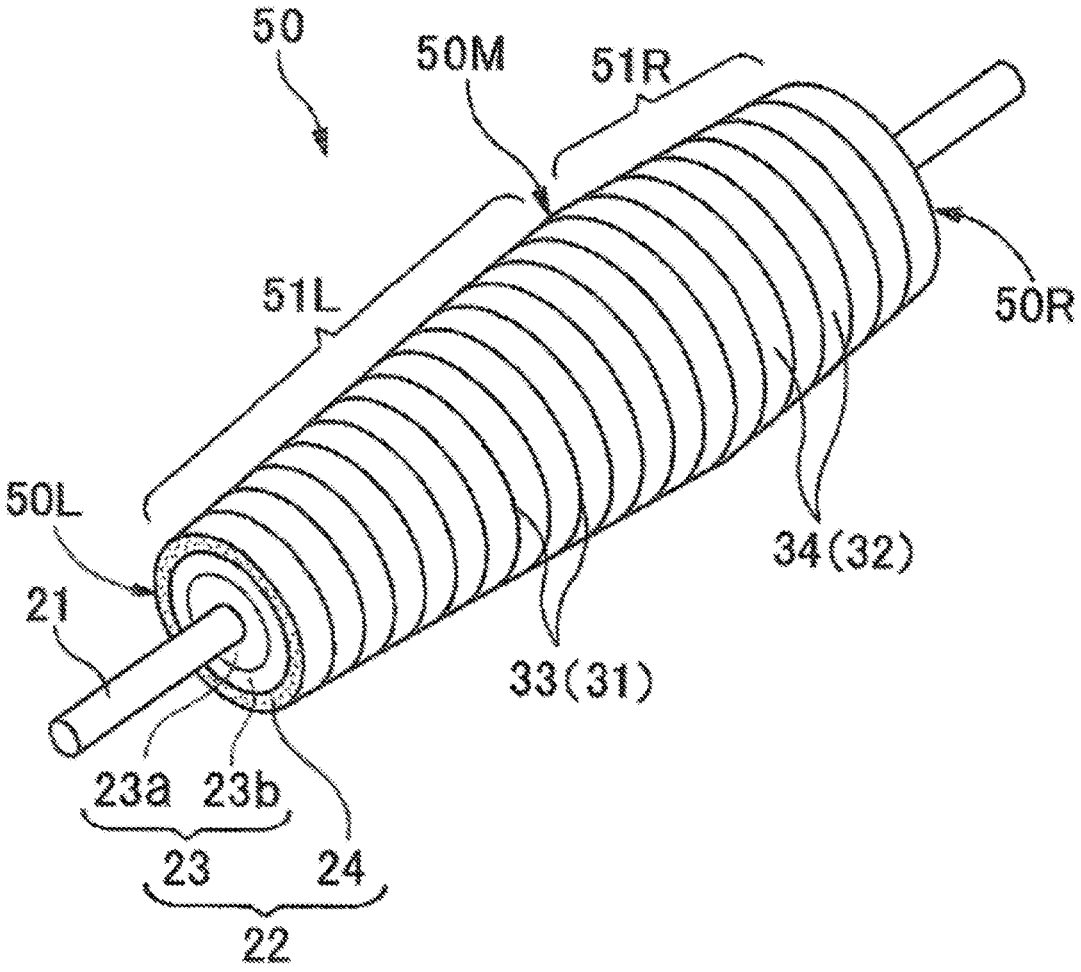
FIG. 4 is a perspective view of an elastic roller (a platen roller 50 having a diameter of a first end that is different from that of a second end) according to a third example of the present embodiment.

FIG. 4 is a perspective view of an elastic roller of a third example of the present embodiment. A platen roller 50 of this example has a diameter of a first end that is different from that of a second end.

This platen roller 50 has a diameter in the plane orthogonal to the axial direction of the roller shaft 21 that is not constant. However, the diameter of a first end 50L in the axial direction is different from that of a second end 50R in the axial direction.

As shown in FIG. 4, the platen roller 50 has a maximum diameter part 50M at a part close to the second end 50R relative to the center part. The platen roller 50 has a shape such that a thick part is placed to one side. Other than such a shape that a thick part is placed to one side, this platen roller includes the inner layer side elastic member 23 (base layer 23*a* and intermediate layer 23*b*) and the coating layer 24 making up the elastic member 22 that are made of the same materials as those of the first example. The internal grooves 31, the coating layer grooves 33, the inner layer platform-shaped apex part 32 and the coating layer platform-shaped apex part 34 are also the same as those of a first example.

The difference between a diameter of the maximum diameter part 50M and that of the first end 50L that is the minimum diameter is 10 to 250 μm.

This platen roller 50 is effective for feeding a label having a width narrower than the width of the print part 12 of the thermal printer 8 (the widths of the thermal head 16 and the platen roller 17) while positioning the label on one side of the print part 12 and printing thereon. For instance, the effective printing width of a 4-inches printer is 104 mm. A label (either a linerless label or a label with a liner) of 40 mm in width is positioned on one side of the print part 12 of this printer for feeding and printing. Then the label is sandwiched between a second side peripheral face 51R including the maximum diameter part 50M and the thermal head 16, and so can be fed and printed stably. On the contrary, a first side peripheral face 51L of the platen roller does not sandwich the label, at which the platen roller 17 and the thermal head 16 rub against directly. This platen roller 50 can reduce a contact between the first side peripheral face 51L of the platen roller 50 and the thermal head 16 or they are not in contact. Therefore, feeding and printing are more stable, and the life of the platen roller 50 can be lengthened.

In FIG. 4, the platen roller 50 has a maximum diameter part 50M at a part close to the second end 50R relative to the center part, and the diameter gradually decreases from that position toward the first end 50L and the second end 50R. The position of the maximum diameter part 50M and the degree of gradually decreasing are not limited to this.

The diameter from the second end 50R to the maximum diameter part 50M, i.e., the diameter of the second side peripheral face 51R may be constant, and the diameter may gradually decrease of the first side peripheral face 51L only.

Alternatively, the platen roller 50 may have a maximum diameter of the second end 50R and the diameter may gradually decrease toward the first end 50L.

The examples as stated above describe an example where the elastic roller is used as a platen roller of a printer. This elastic roller may be used as other rollers such as a guide roller and a nip roller that have its separation property (non-stick property), gripping property and abrasion resistance. In addition to them, this elastic roller may be used as an attaching (pressing) roller of an automatic attachment device of labels, and a guide roller, a deflecting roller and a driving roller of a printer, various coaters, and processing equipment of belt-shaped articles.

REFERENCE SIGNS LIST

1 linerless label
1A label piece of linerless label
2 label base
3 adhesive layer
4 thermosensitive color developing layer
5 separation agent layer
6 position detection mark
7 cutting line
8 thermal printer
9 feed part
10 guide part

11 detection part
12 print part
13 cutting part
14 guide roller
15 position detection sensor
16 thermal head
17 platen roller
18 fixed blade
19 movable blade
21 roller shaft
22 elastic member
23 inner layer side elastic member
23*a* base layer
23*b* intermediate layer
24 coating layer
30 platen roller
31 internal groove
32 inner layer platform-shaped apex part
33 coating layer groove
34 coating layer platform-shaped apex part
40 platen roller
50 platen roller
50L first end
50M maximum diameter part
50R second end
51L first side peripheral face
51R second side peripheral face
T thickness of coating layer 24
P pitch of internal grooves 31
W width of internal grooves 31
H depth of internal grooves 31
G groove angle of internal grooves 31

The invention claimed is:

1. An elastic roller, comprising:
a roller shaft; and
an elastic member surrounding around the roller shaft, the elastic roller configured to feed a belt-shaped member while the belt-shaped member contacts the elastic member,
wherein
the elastic member includes:
an inner layer side elastic member surrounding around the roller shaft; and
a coating layer surrounding around the inner layer side elastic member, the coating layer contacting the belt-shaped member when feeding the belt-shaped member,
the inner layer side elastic member including a base layer and an intermediate layer located from the roller shaft in this order,
the base layer and the intermediate layer having a rubber hardness of 30 to 80 degrees, the rubber hardness being measured by a durometer type A in accordance with the standard of JIS K 6253,
the rubber hardness of the base layer being more than the rubber hardness of the intermediate layer,
the intermediate layer having tearing strength of 25 N/mm or more, the tearing strength being measured using an unnicked angle-shaped test piece in accordance with JIS K 6252,
the coating layer being made of silicone resin having hardness of 20 degrees or less, the hardness being measured using a spring-based Asker C type in accordance with SRIS 0101 standard,
the coating layer having a thickness of 10 to 100 μm,
the intermediate layer having a plurality of internal grooves along a circumferential direction of the intermediate layer,
each of the internal grooves having a width of 25 to 1,300 μm,
each of the internal grooves having a depth of 25 to 500 μm, and
each of the internal grooves having a V-shaped cross section and having a groove angle of 40 to 160 degrees.

2. The elastic roller according to claim 1, wherein the silicone resin is of a thermosetting type.

3. The elastic roller according to claim 1, wherein the inner layer side elastic member is made of a thermoplastic elastic material or a thermosetting elastic material.

4. The elastic roller according to claim 1, wherein the coating layer has a plurality of coating layer grooves along a circumferential direction of the coating layer.

5. The elastic roller according to claim 1, wherein the intermediate layer has a flat inner layer platform-shaped apex part between neighboring internal grooves.

6. The elastic roller according to claim 4, wherein the coating layer has a flat coating layer platform-shaped apex part between neighboring coating layer grooves.

7. The elastic roller according to claim 1, wherein the internal grooves have a pitch of 500 to 1,500 μm.

8. The elastic roller according to claim 1, wherein the elastic roller has a constant diameter in a plane orthogonal to an axial direction of the roller shaft.

9. The elastic roller according to claim 1, wherein the elastic roller has a diameter in a plane orthogonal to an axial direction of the roller shaft, the diameter gradually decreasing from a center part of the elastic roller toward both ends of the elastic roller along the axial direction of the roller shaft.

10. The elastic roller according to claim 1, wherein the elastic roller has a diameter in a plane orthogonal to an axial direction of the roller shaft, the diameter of a first end of the elastic roller in the axial direction of the roller shaft being different from that of a second end of the elastic roller in the axial direction thereof.

11. The elastic roller according to claim 1, wherein
the base layer has a rubber hardness of 60 to 80 degrees, the rubber hardness being measured by a durometer type A in accordance with the standard of JIS K 6253, and
the intermediate layer has a rubber hardness of 30 to 40 degrees, the rubber hardness being measured by a durometer type A in accordance with the standard of JIS K 6253.

12. The elastic roller according to claim 1, wherein the intermediate layer has a tearing strength of 27 to 45 N/mm, the tearing strength being measured using an unnicked angle-shaped test piece in accordance with JIS K 6252.

13. The elastic roller according to claim 1, wherein
the elastic roller is disposed in a thermal printer having a thermal head, the elastic roller being a platen roller to be rotary-driven while sandwiching a label as the belt-shaped member between the platen roller and the thermal head, and
a print pressure between the elastic roller and the thermal head is 1.0 to 2.0 Kg/2 inch.

14. The elastic roller according to claim 2, wherein the inner layer side elastic member is made of a thermoplastic elastic material or a thermosetting elastic material.

15. The elastic roller according to claim 2, wherein the coating layer has a plurality of coating layer grooves along a circumferential direction of the coating layer.

16. The elastic roller according to claim 2, wherein the intermediate layer has a flat inner layer platform-shaped apex part between neighboring internal grooves.

17. The elastic roller according to claim 15, wherein the coating layer has a flat coating layer platform-shaped apex part between neighboring coating layer grooves.

18. The elastic roller according to claim 2, wherein the internal grooves have a pitch of 500 to 1,500 μm.

19. The elastic roller according to claim 2, wherein the elastic roller has a constant diameter in a plane orthogonal to an axial direction of the roller shaft.

20. The elastic roller according to claim 2, wherein the elastic roller has a diameter in a plane orthogonal to an axial direction of the roller shaft, the diameter gradually decreasing from a center part of the elastic roller toward both ends of the elastic roller along the axial direction of the roller shaft.

* * * * *